US011535416B2

(12) United States Patent
Swartz et al.

(10) Patent No.: US 11,535,416 B2
(45) Date of Patent: Dec. 27, 2022

(54) EXPANDABLE CONTAINER AND SYSTEM COMPRISING SUCH A CONTAINER

(71) Applicants: SCHOELLER ALLIBERT GMBH, Schwerin (DE); ALERT INNOVATION, North Billerica, MA (US)

(72) Inventors: Dennis Swartz, Spring Lake, MI (US); William Fosnight, Windham, NH (US); John Dyer, Staffordshire (GB)

(73) Assignees: Schoeller Allibert GmbH, Schwerin (DE); Alert Innovation, North Billerica, MA (US)

( * ) Notice: Subject to any disclaimer, the term of this patent is extended or adjusted under 35 U.S.C. 154(b) by 358 days.

(21) Appl. No.: 16/763,474

(22) PCT Filed: Nov. 14, 2017

(86) PCT No.: PCT/EP2017/079126

§ 371 (c)(1),
(2) Date: May 12, 2020

(87) PCT Pub. No.: WO2019/096364

PCT Pub. Date: May 23, 2019

(65) Prior Publication Data

US 2020/0331651 A1 Oct. 22, 2020

(51) Int. Cl.

| | |
|---|---|
| ***B65D 1/22*** | (2006.01) |
| ***B65D 21/06*** | (2006.01) |
| ***B65D 77/04*** | (2006.01) |

(52) U.S. Cl.

CPC ..... *B65D 1/22* (2013.01); *B65D 21/068* (2013.01); *B65D 77/042* (2013.01)

(58) Field of Classification Search

CPC ..... B65D 1/22; B65D 21/068; B65D 77/042

(Continued)

(56) References Cited

U.S. PATENT DOCUMENTS 4,580,681 A 4/1986 Braun

FOREIGN PATENT DOCUMENTS

DE 102005021170 A1 11/2006
EP 0610870 A1 8/1994

(Continued)

OTHER PUBLICATIONS

Office Action received in Japanese Application No. 2020-544104 dated Sep. 30, 2021, with translation, 6 pages.

(Continued)

*Primary Examiner* — Andrew D Perreault

(74) *Attorney, Agent, or Firm* — Christopher A. Rothe; Culhane Meadows, PLLC

(57) ABSTRACT

An expandable container includes a substantially horizontal base, four side walls, and a rim defining a container opening having a larger cross section than the base. At least one of the four side walls is configured as a movable side wall, having an upwardly extending side portion and a substantially horizontal base portion. An upper edge portion of the side portion is connected to the rim by a hinge such that the movable side wall is movable between a nesting position, in which the side wall is inclined to facilitate nesting of the container inside another container, and an expanded position, in which the side wall is moved outwardly to increase the storage space of the container, when compared to the nesting position. A system includes a main tote in which a plurality of expandable containers as described above may be nested.

13 Claims, 4 Drawing Sheets

(58) Field of Classification Search
USPC ..... 206/546
See application file for complete search history.

(56) References Cited

FOREIGN PATENT DOCUMENTS

| | | | |
|---|---|---|---|
| EP | 1013561 | A2 | 6/2000 |
| EP | 3034425 | A1 | 6/2016 |
| GB | 2429687 | A | 3/2007 |
| JP | S61104948 | A | 5/1986 |
| JP | S6128765 | U | 8/1986 |
| JP | 2010083521 | A | 4/2010 |
| JP | 2013216338 | A | 10/2013 |

OTHER PUBLICATIONS

Office Action received in Chinese Application No. 201780097932.4 dated Aug. 2, 2021, with translation, 18 pages.
International Search Report and Written Opinion for Application No. PCT/EP2017/079126, dated Oct. 15, 2018,17 pages.

EXPANDABLE CONTAINER AND SYSTEM COMPRISING SUCH A CONTAINER

CROSS-REFERENCE TO RELATED APPLICATION(S)

This application is the United States national phase entry of international application no. PCT/EP2017/079126, filed Nov. 14, 2017, the content of which is incorporated by reference herein in its entirety.

FIELD

The following invention relates to an expandable container comprising a substantially horizontal base; (four) side walls; and a rim defining a container opening having a larger cross section than the base, wherein at least one of the (four) side walls is configured as a movable side wall, having an upwardly extending side portion and a substantially horizontal base portion, an upper edge portion of the side portion being connected to the rim by a hinge such that the movable side wall is movable between a nesting position, in which the side wall is inclined to facilitate nesting of the container inside another container and an expanded position, in which the side wall is moved outwardly to increase the storage space of the container, when compared to the nesting position. The invention further relates to a system comprising a main tote in which a plurality of expandable containers as described above may be nested and to a manufacturing process for manufacturing an expandable container.

BACKGROUND

Especially in the field of automated storage and retrieval system (ASRS or AS/RS) there is a rising need for systems of main totes, in which a number of sub-totes may be nested. However, a huge disadvantage of known systems of this type is that they lose valuable storage space because of the inclination of the side walls of the sub totes. This problem may be overcome by providing multiple different sub-totes each with an individual configuration of inclined and upright side walls, however such a configuration necessitates multiple injection molding tools and further has the drawback that the sub-totes have to be arranged inside the main-tote in a specific orientation and order, which in turn complicates the handling of the system.

SUMMARY

The drawbacks of conventional nestable containers are resolved by expandable nestable containers in accordance with the invention. Accordingly, the present invention is directed towards an expandable and nestable container with a comparatively simple construction and easy handling. Additionally, it is a preferred goal of the invention to provide a container, which maximizes storage volume, when nested inside another container. Further, the invention is directed towards a system with a main-tote and a plurality of sub-totes with a comparatively simple construction, easy handling and which maximizes storage volume, when the sub-totes are nested within the main-tote. Further, a manufacturing process for an expandable and nestable container is suggested which allows for the simple and efficient manufacturing of such a container.

According to a first aspect of the invention an expandable container is provided, comprising: a base; four side walls; and a rim defining a container opening having a larger cross section than the base. At least one of the four side walls is configured as a movable side wall, having an upwardly extending side portion and a substantially horizontal base portion, an upper edge portion of the side portion being connected to the rim by a first hinge such that the movable side wall is movable between a nesting position, in which the side wall is inclined to facilitate nesting of the container inside another container and an expanded position, in which the side wall is moved outwardly to increase the storage space of the container, when compared to the nesting position. The above described container design allows for a uniform container design which automatically adapts the inclination of its side walls, when nested into another container and which automatically expands its interior storage space if enough external space is provided (e.g. when the container is being filled).

The side portion of the movable side wall may be substantially perpendicular to the base (vertical), when positioned in the expanded position.

According to an embodiment of the invention the base portion of the movable side wall may be coupled to the base such that, when the side wall is moved between the nesting position and the expanded position, the base portion performs a guided movement in a plane substantially parallel to the base. In other words the joint connecting the base and the base portion of the movable side wall may be designed such that it prevents the base portion to move away (lift upwards) from the base, when the movable side wall moves inwards. The base portion may lie flat on an upper face of the base and be coupled such that it remains in this flush alignment. Such embodiments have the advantage that storage space of the container is maximized, even when the movable side wall is moved inwards.

The side portion of the movable side wall may comprise a second hinge in proximity to the base portion, which allows for accommodation of the angle between the side portion and the base portion, when the movable the side wall is moved between the nesting position and the expanded position. In other words a second hinge is provided as an interlocking joint that absorbs the tensions otherwise caused by movement of the movable side wall with its flexibility.

In an embodiment the base portion may be coupled to the base by a protruding section that will insert into features of the base or vice versa, e.g. a slot and bolt connection, a coulisse track or a tongue and groove connection, in order to force the guided horizontal movement. In a further embodiment a slot and bolt connector/joint may be configured for snap/lock engagement, which allows for assembly without tools. This can be implemented e.g. by hooks provided at the distal (free) end of the bolt. The bolts are formed integrally into the base or the base portion.

The joint between the base and the base portion may be configured to limit the travel between the two.

According to an embodiment, the movable side wall may comprise at least one flap arranged at one of its lateral edges and extending towards the container interior in a direction substantially parallel to an adjacent side wall. The flap may lie flat on an inner face of the adjacent side wall. With an above described flap the gap between the movable side wall and the adjacent side wall may be covered/blocked to prevent stored goods from falling out of the container, when the movable side wall is in the extended position. The movable side wall can comprise at least one first flap arranged on a lateral edge of the side portion and between the first hinge and the second hinge and at least one second flap arranged between the second hinge and the base portion. One could also say that flap-like structures are provided for reducing the amount of free gap in the corners of the container to limit product from falling out.

The container may comprise a pair of opposed movable side walls and a pair of opposed rigid side walls.

In one embodiment each of the opposed rigid side walls may comprise an outward step forming a defined support area, for supporting the expandable container, when it is nested inside another container. Through such design contact area during nesting and therefore the risk of wedging between containers can be minimized.

The first and/or the second hinge may be implemented as an integral film hinge (a thinning of material to provide flexibility. This design option facilitates integral molding of the container in one piece. Accordingly it is preferred to make the container of a polymer material, in particular by injection molding the base, the four side walls and the rim in one piece.

The movable side walls may be biased in the expanded position, e.g. by the internal elasticity of their material.

A second aspect of the present invention concerns a production method for producing an expandable container as described above and comprising at least the following steps:

molding the container in one piece with the at least one movable side wall being disconnected from the base; and joining the base portion of the movable side wall to the base in a manner that allows for a horizontal relative movement between the base portion and the base.

A third aspect of the invention is directed towards a system comprising a nestable main-tote and a plurality of expandable containers as described above, which may be nested inside the main-tote as sub-totes. According to the invention, the movable side walls of the nested sub-totes, which are adjacent to the inclined walls of the main-tote, are positioned in the nesting position and the movable side walls, which are adjacent to another sub-tote, can expand into a substantially upright (expanded) position to maximize the utilizable storage space. The main-tote may comprise a number of recesses in its side walls and the sub-totes may each comprise at least on hook or tab which may be engaged with the recesses, in order to secure the sub-totes inside the main-tote.

BRIEF DESCRIPTION OF THE DRAWINGS

The invention will now be described, by way of example, with reference to the accompanying drawings, in which.

DETAILED DESCRIPTION

Referring now to the FIGS. 1 to 7, the depicted container 1 according to a preferred embodiment of the invention has a substantially rectangular base 2 and four side walls 3, 4 extending therefrom, which are connected by a rim 5 at their ends opposite to the base 2. The depicted container 1 is designed to be nestable with a structurally identical container. For this reason the cross-section of the base 2 is smaller than the container opening defined by the rim 5.

Figure 8:
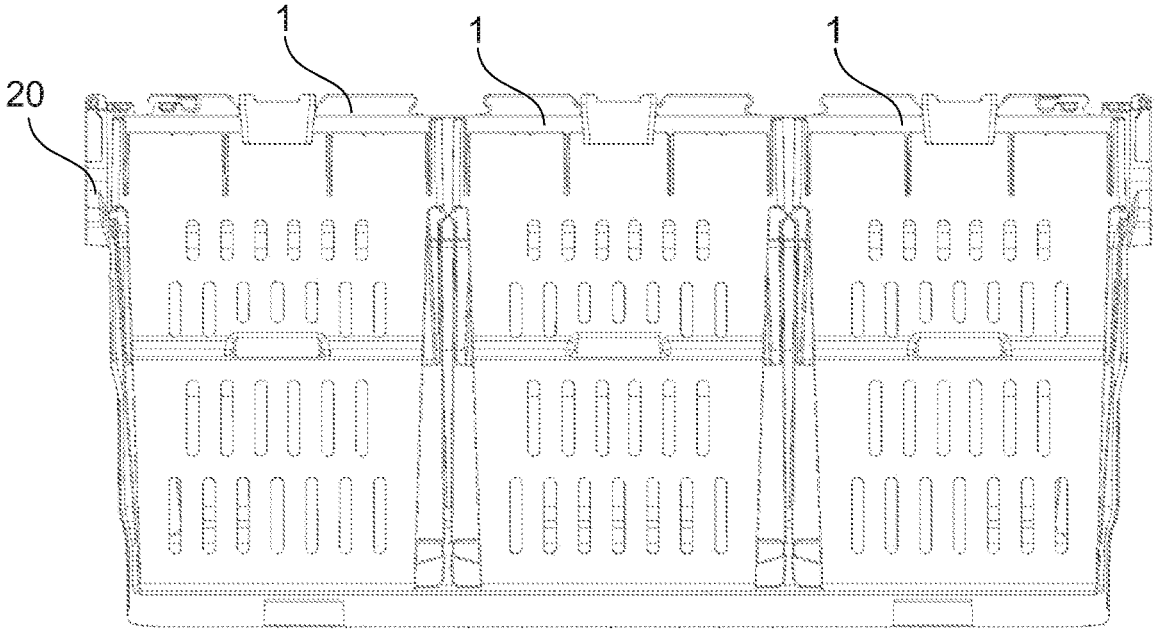
FIG. 8 shows a cross-sectional view of a system comprising a main-tote and multiple sub-totes according to a preferred embodiment of the invention.

As shown in FIG. 8, the container 1 according to the preferred embodiment is intended for use as a sub-tote in a system together with a larger main-tote 20, which is adapted to receive a plurality of sub-totes 1. The above mentioned nestable design of the container 1 requires an inclination of the side walls, which in turn causes a waste of usable storage space, when a plurality of containers 1 is nested inside a nestable main-tote 20. To remedy this drawback, the container 1 according to the preferred embodiment of the invention has a unique feature implemented, when compared to similar nestable containers, which allows for maximizing the utilized storage space, when the container 1 in nested within a larger container or main-tote 20. This is achieved by designing two of the four side walls 3, 4 as movable side walls 4, such that the movable side walls 4 in contact with the inclined walls of the main-tote 20 can swing inward and adopt the inclined orientation necessary for nesting, while the movable side walls 4 facing another sub-tote container 1 can adopt an expanded substantially vertical position (cf. FIG. 8).

In order to implement the above described feature, the movable side walls 4 are connected to the rim 5 via a first hinge 4.4 with their upper edge regions, to allow for a swinging or pivoting movement relative thereto. The first hinge 4.4 is implemented as an integral film hinge in the preferred embodiment. In the depicted embodiment, the movable side walls 4 are separated from the rigid side walls 3 to allow for their pivoting relative movement. As the skilled person will appreciate however, the movable side walls 4 may as well be coupled to the rigid side walls 3 by a joint or connection, which allows for the appropriate relative movement.

Figure 5:
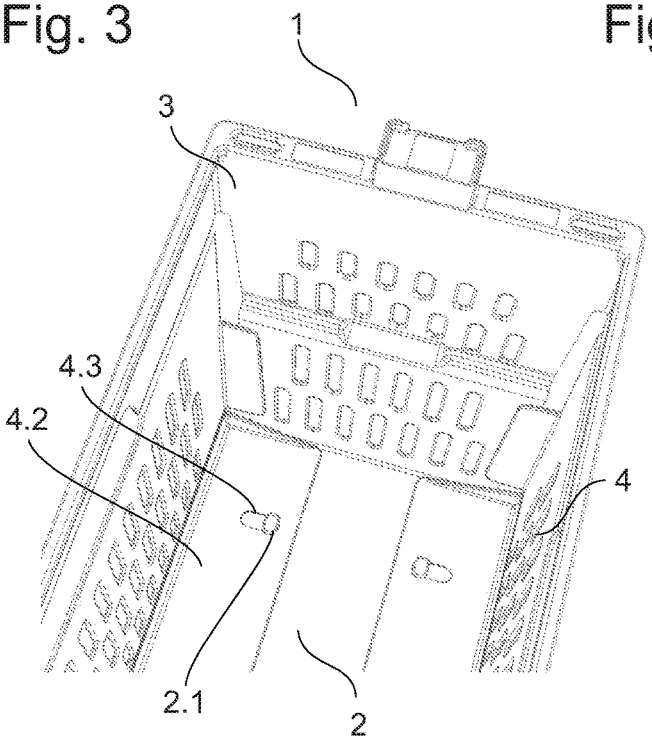
FIG. 5 shows a more detailed perspective view of the expandable container according to the preferred embodiment of the invention.
Figure 6:
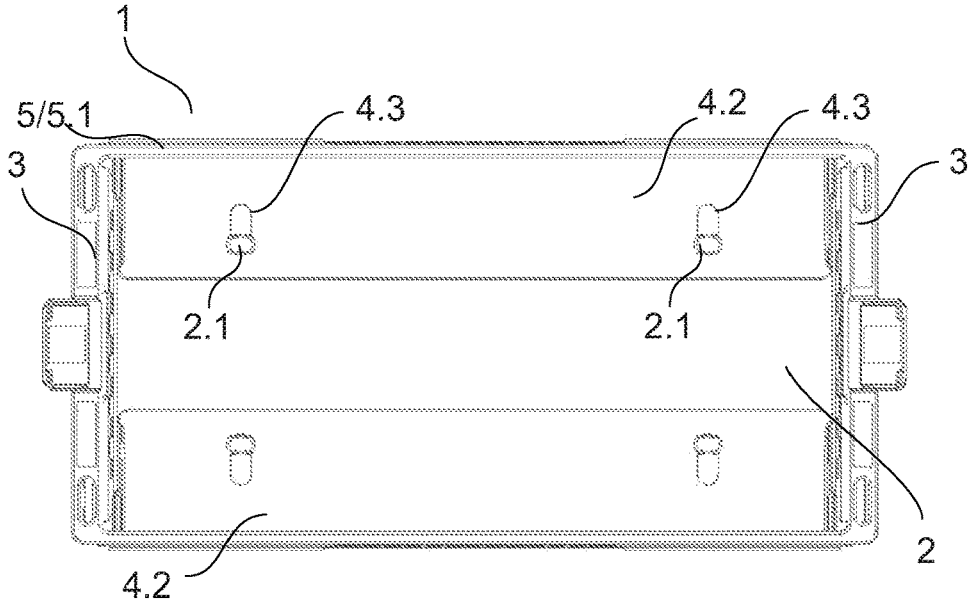
FIG. 6 shows a top view of the expandable container according to the preferred embodiment of the invention.
Figure 7:
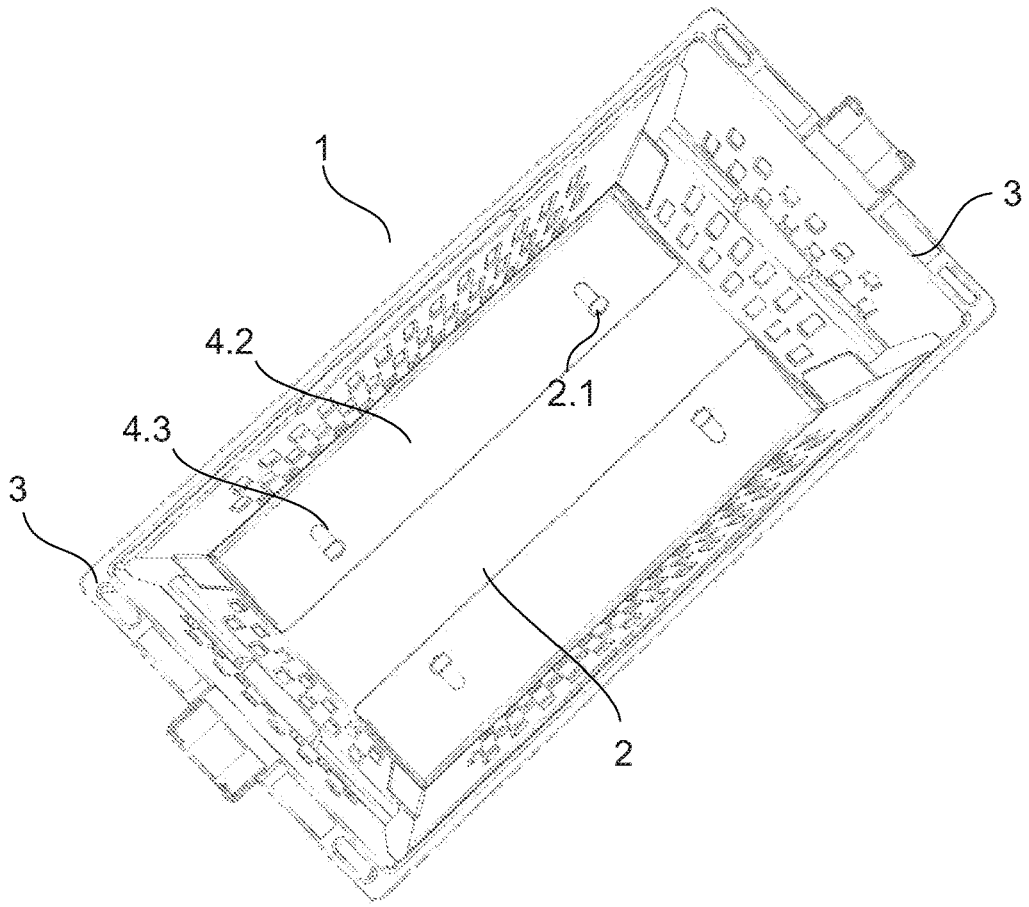
FIG. 7 shows a perspective top view of the expandable container according to the preferred embodiment of the invention.

The movable side walls 4 can be described as being substantially L-shaped, when viewed from the side, having an upwardly extending (vertical) side portion 4.1 and a (horizontal) base portion 4.2 orientated substantially perpendicular to the side portion 4.1 and substantially parallel to the base 2. The L-shape of the movable side walls 4 ensures a closed inner base surface of the container 1 even if the movable side wall 4 pivots into the extended position. The base portions 4.2 of the movable side walls 4 are positioned in flush alignment with an upper (inner) face of the base 2. As best seen in FIG. 5, the base portions 4.2 are movably coupled to the base 2. In particular, the base portions 4.2 are coupled to the base 2 such that they can only perform a guided motion in a plane parallel to the base 2. In the depicted preferred embodiment, this is achieved a combination of slots 4.3 (oblong holes) provided in the base portion 4.2, which are each engaged by a bolt or tongue 2.1 provided in the base 2. The depicted bolts 2.1 are formed integrally with the base 2. The described slot and bolt connection has the advantage that the base portion 4.2 cannot move upward, when the movable side wall 4 pivots inwards during nesting, which would compromise storage space of a nested container 1. Additionally the slot and bolt connection provides a limit stop, limiting the inward and outward movement of the movable side wall 4 during expansion and nesting. As the skilled person will appreciate, alternative kinematics which allow for guided parallel (horizontal) movement of the base portion 4.2 are also possible and contemplated as e.g. coulisse tracks or tongue and groove connections or four-link systems. In the preferred embodiment the bolt 2.1 is designed to extend upwardly from an upper (inner) face of the base. The depicted bolt has a pair of hooks or wings at its distal edge for snapping engagement with the slot 4.3 thereby enabling assembly of the joint without tools. Thus, an undercut is formed, which prevents accidental separation of the joint between base 2 and base portion 4.2.

Because the angle of the side portion 4.1 changes when the movable side wall 4 pivots, while the base portion 4.2 remains parallel to the base 2, a second hinge 4.4 is provided in the side portion 4.1 adjacent to the base portion 4.2 to compensate for this change in the relative angle between the side portion 4.1 and the base portion 4.2.

In order to minimize the gap between the movable side walls 4 and the rigid side walls 3, when the movable side walls 4 are positioned in the extended position, first and second flaps 4.6, 4.7 are integrally formed onto the lateral edges movable side walls adjacent to the rigid side walls 3. The first and second flaps 4.6, 4.7 are in flush alignment with an inner face of the rigid side walls 3, such that an undercut is formed preventing the first and second flaps 4.6, 4.7 from being pushed outwards by goods stored inside the container 1. The first flaps 4.6 are arranged adjacent to the second hinge 4.5 and above the same, whereas the second flaps 4.7 are arranged adjacent to the second hinge 4.5 but below the same. The second flaps 4.7 are also attached to the lateral edges of the base portion 4.2. One could also say that the second flaps 4.7 and the base portion 4.2 form a shovel-shaped configuration.

The rigid side walls 3 are rigidly connected with the base 2 and arranged in a substantially U-shaped configuration together with the base, when viewed from the side. A step 3.1 is provided in each rigid side wall 3, which is configured such that an upper portion of the rigid side wall 3 is shifted outwardly with respect to a lower portion of the rigid side wall 3, which is adjacent to the base 2. The step 3 forms a defined support area, for supporting the expandable container when it is nested inside another (structurally identical) container or the main-tote 20. The step 3.1 thus minimizes contact area when nesting and reduces the risk of wedging between nested containers 1.

Figure 9:
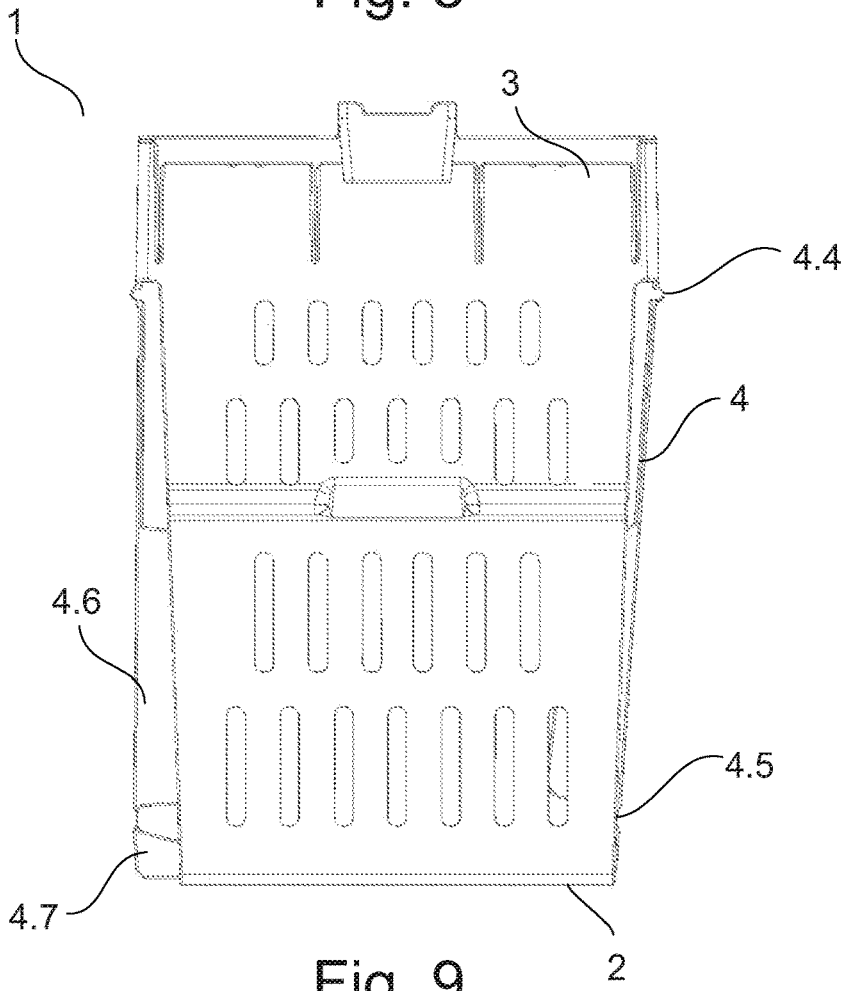
FIG. 9 shows a side view of the expandable container according to the preferred embodiment of the invention with one movable side wall positioned in the nesting position and another movable side wall positioned in the expanded position.

FIG. 9 shows a container 1 according to the preferred embodiment in a side view with its left movable side wall 3 being positioned in the expanded position and its right movable side wall 3 being positioned in the nesting position. As best seen in this figure, the movable side wall 3 adopts an upright or substantially vertical position when expanded (left) and is pivoted into an inwardly inclined position, when nested (right). Referring once again to FIG. 8, an intended use of the container 1 in a system comprising a main tote 20 is described. According to said intended use, a plurality of structurally identical containers 1 is nested (inserted) into a larger main-tote 20, which itself is provided with inclined side walls to enable nesting of multiple (empty) main-totes 20. Due to the inclination of the main-tote 20 walls, the movable side walls 4 of the empty containers 1, which are adjacent to the main-tote 20 walls, are automatically moved inwards into the nesting position whereas the remaining movable side walls 4 are able to expand thereby minimizing waste of space for storage. In this configuration the containers 1 may be filled with goods. By way of example, each container 1 may be filled with goods, which are to be commissioned to a separate customer. After filling, the separate containers 1 may be taken out of the main-tote 20 by way of manual and/or automatic handling to be further commissioned. An empty sub-tote may be initially inserted into the main-tote with its movable side walls inclined. As goods are inserted into the sub-tote, one or both movable side walls of the sub-tote may be pushed out to a vertical position.

Because of the missing structural connection between the rigid side walls 3 and the movable side walls 4, the rim 5 is reinforced by a circumferential lip 5.1 providing increased stability and stiffness to the container 1. The lip 5.1 forms two hooks 5.2 which can engage corresponding recesses in the main tote 20 to secure the container 1 inside the main-tote 20. A plurality of reinforcing ribs is connecting the lip 5.1 to the side walls 3, 4 is provided to further improve stability.

The side walls 3, 4 of the container according to the preferred embodiment are provided with a perforation in order to reduce weight and improve circulation of air between the containers 1, e.g. for the cooling of goods.

Figure 1:
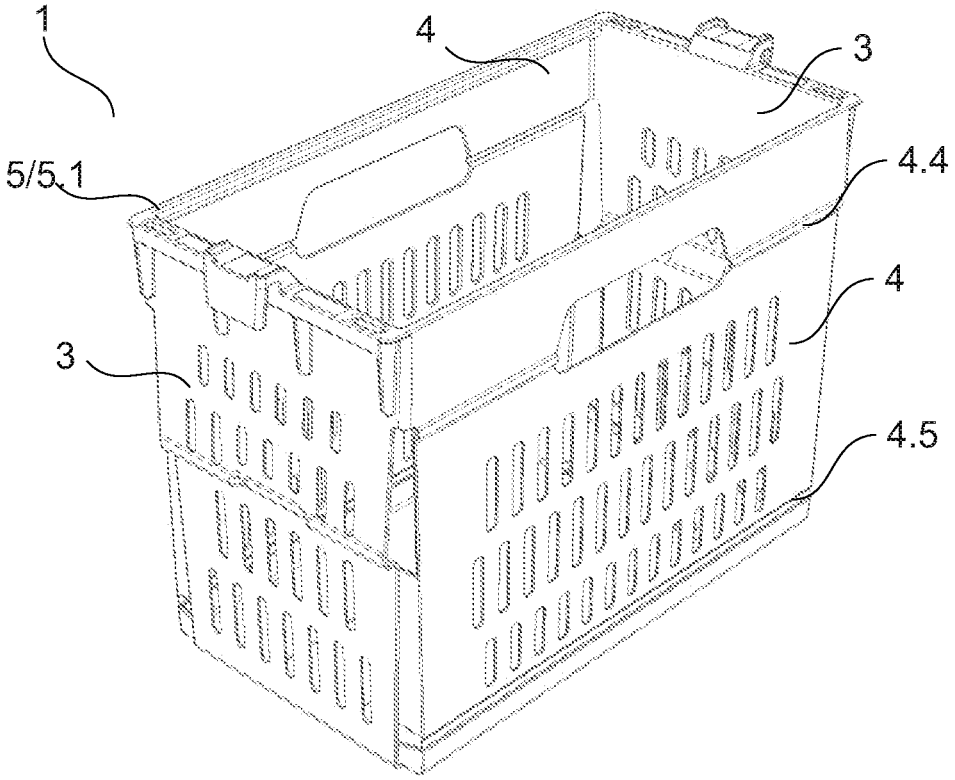
FIG. 1 shows a perspective view of an expandable container according to a preferred embodiment of the invention.
Figure 2:
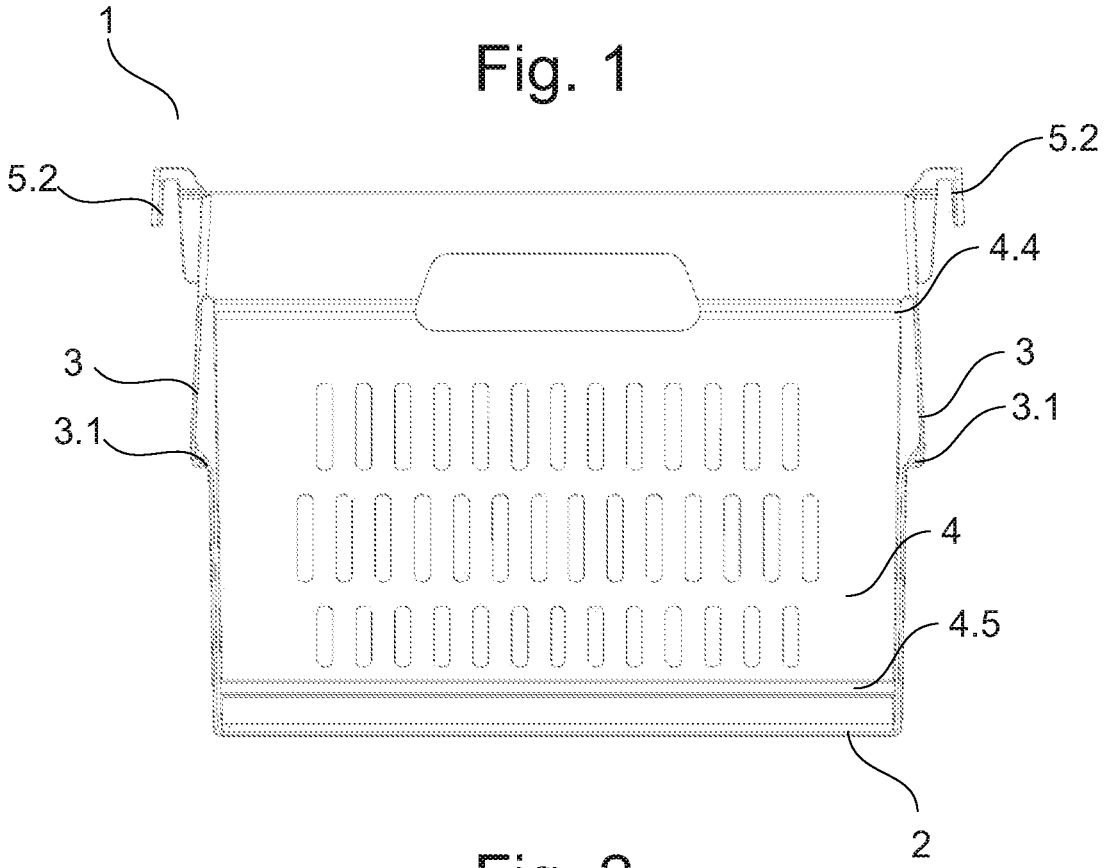
FIG. 2 shows a side view of the expandable container according to the preferred embodiment of the invention.
Figure 3:
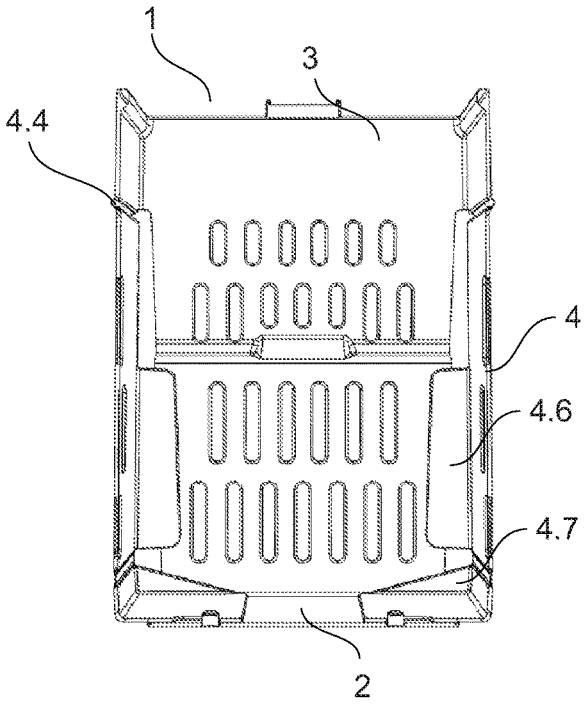
FIG. 3 shows a cross-sectional view of the expandable container according to the preferred embodiment of the invention.
Figure 4:
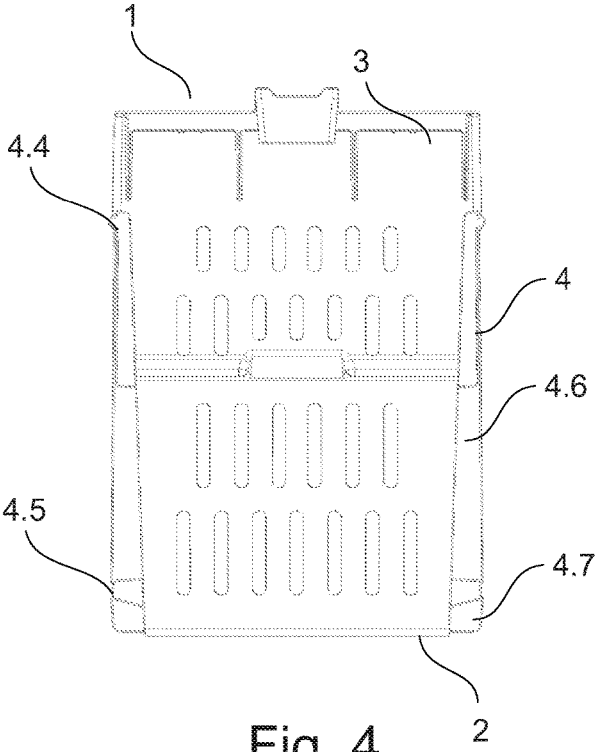
FIG. 4 shows a side view of the expandable container according to the preferred embodiment of the invention.

As best seen in FIG. 1, the movable side walls 4 are provided with openings for handling of the container 1. These openings are placed such that they interrupt the first hinge 4.4, thereby improving the flexibility of the joint and allowing for manipulating the movable side wall 4 while gripping the handle at the same time.

The depicted preferred container 1 is made of a thermoplastic material and is manufactured in one piece by an injection molding process. The implementation of the first and second hinges 4.4, 4.5 as film hinges facilitates the integral manufacturing of the container 1. To avoid undercuts when demolding the container 1 the container may be molded in a position in which the movable side walls 4 are spread away from the rest of the container 1 and the side portions 4.1 are substantially parallel to the base 2. The base portions 4.2 may then be joined with the base 2 via the integral slot 4.3 and bolt 2.1 connectors in a subsequent manufacturing step. In an alternative embodiment concerning a production method for a nestable container, in a first step a container similar to the first embodiment may be manufactured in one piece by an injection molding process. However, in the alternative embodiment, instead of movably coupling the movable side wall to the base, the side and/or base portions may be permanently attached to the base and/or adjacent rigid side walls, e.g. by (ultrasonic) welding or by applying an adhesive to create sub-totes with permanent configurations of inclined and vertical side walls. In other words an expandable container according to the invention may be produced as a sort of pre-form, which is then inserted into a main-tote. As the configuration of movable side walls of this pre-form container adapts to the main-tote, the movable side wall(s) can be permanently joined to the base and/or adjacent side walls to create a rigid nestable container with a determined configuration of inclined and vertical side walls. This production method has the advantage that a single injection-molding tool can be used for the production the nestable sub-totes, which are then individually configured and permanently joined in a following production step.

The invention claimed is:

1. An expandable container comprising:

a base;

side walls; and a rim defining a container opening having a larger cross section than the base, wherein at least one of the side walls is a moveable side wall, having an upwardly extending side portion and a substantially horizontal base portion, an upper edge portion of the side portion being connected to the rim by a first hinge such that the movable side wall is movable between a nesting position, in which the side wall is inclined to facilitate nesting of the container inside another container and an expanded position, in which the side wall is moved outwardly to increase the storage space of the container, when compared to the nesting position, wherein the base portion of the movable side wall is coupled to the base such that, when the side wall is moved between the nesting position and the expanded position, the base portion performs a guided movement in a plane substantially parallel to the base, wherein a joint is provided that connects the base portion of the side wall and the base that prevents the base portion from moving away from the base, when the movable side wall moves inwards.

2. The expandable container according to claim 1, wherein the side portion of the movable side wall comprises a second hinge in proximity to the base portion which allows for accommodation of the angle between the side portion and the base portion, when the movable side wall is moved between the nesting position and the expanded position.

3. The expandable container according to claim 1, wherein the base portion is coupled to the base by a slot and bolt connection, a coulisse track or a tongue and groove connection, in order to force the guided horizontal movement.

4. The expandable container according to claim 1, wherein the movable side wall comprises at least one flap arranged at one of its lateral edges and extending towards the container interior in a direction substantially parallel to an adjacent side wall.

5. The expandable container according to claim 1, wherein the movable side wall comprises at least one first flap arranged on a lateral edge of the side portion and between the first hinge and the second hinge and at least one second flap arranged between the second hinge and the base portion.

6. The expandable container according to claim 1, comprising a pair of opposed movable side walls and a pair of opposed rigid side walls.

7. The expandable container according to claim 1, wherein each of the opposed rigid side walls comprises an outward step forming a defined support area, for supporting the expandable container, when it is nested inside another container.

8. The expandable container according to claim 1, wherein the base portion of the movable side wall is arranged flat on an upper face of the base.

9. The expandable container according to claim 1, wherein the movable side wall is connected to the rim by a film hinge.

10. The expandable container according to claim 1, wherein the second hinge is an integral film hinge.

11. The expandable container according to claim 1, wherein the container is made of a polymer material.

12. The expandable container according to claim 1, wherein the base, the four side walls and the rim are molded in one piece.

13. The expandable container according to claim 1, wherein the movable side wall is substantially upright in the expanded position.

* * * * *